United States Patent [19]

Card

[11] 4,171,763

[45] Oct. 23, 1979

[54] DISPLAY CARRY CONTAINER

[75] Inventor: David R. Card, Memphis, Tenn.

[73] Assignee: Champion International Corporation, Stamford, Conn.

[21] Appl. No.: 924,621

[22] Filed: Jul. 14, 1978

[51] Int. Cl.[2] ..... B65D 5/46; B65D 5/10

[52] U.S. Cl. ..... 229/52 B; 229/39 R

[58] Field of Search ..... 229/52 B, 39 R

[56] References Cited

U.S. PATENT DOCUMENTS

| | | | |
|---|---|---|---|
| 2,141,752 | 12/1938 | Hoarle | 229/44 R |
| 2,331,754 | 10/1943 | Wohlers | 229/39 R |
| 2,598,051 | 5/1952 | Guyer et al. | 229/52 B |
| 2,663,485 | 12/1953 | Johnson | 229/52 B |
| 2,730,294 | 1/1956 | Stavis et al. | 229/52 B |
| 2,916,195 | 12/1959 | Gatward | 229/52 B |
| 2,959,337 | 11/1960 | Grave, Jr. | 229/52 B X |
| 3,140,811 | 7/1964 | Hall et al. | 229/52 B X |
| 3,283,950 | 11/1966 | Bolding | 229/52 BC X |
| 4,003,515 | 1/1977 | Steele | 229/52 B |
| 4,017,019 | 4/1977 | Booth | 229/39 R |

*Primary Examiner*—Davis T. Moorhead

*Attorney, Agent, or Firm*—Evelyn M. Sommer

[57] ABSTRACT

A display carry container having first and second opposed side wall panels, first and second end wall panels and bottom closure panels for closing the bottom of said container, and an improved top closure comprising a first flap integrally formed with said first side wall panel and having a handle integrally formed therein, second and third flaps integrally formed with said first and second end wall panels respectively for overlapping said first flap and forming an elongated slot through which said handle protrudes, a fourth flap integrally formed with said second side wall panel and having an elongated slot therein through which said handle protrudes when said fourth flap overlaps said second and third flaps, and means removably retaining said fourth flap in its overlapped position.

14 Claims, 10 Drawing Figures

DISPLAY CARRY CONTAINER

BACKGROUND OF THE INVENTION

There are many types of cartons which have carry handles integrally formed therein or attached thereto to enable the carton to be carried in an easy manner. If the handle is integrally formed with the carton, it is usually formed in one of a multiplicity of top panels which are folded and/or glued together in order to give strength to the combination so that the handle will not tear the panels or be torn from the panels because of the weight of the product in the carton. In like manner, handles that are attached to cartons are attached to a plurality of glued panels in order to have a point of strength at which to attach the handle.

Display carry containers pose a special problem where handles are to be integrally formed with or attached thereto because the top panels to which the handle is attached or with which the handle is integrally formed are not glued together because the carton must be constantly opened and closed in order to display the contents thereof. Thus, the weight of the carton and its contents are constantly applying forces to the point at which the handle is attached or integrally formed with one of the top closure panels and those forces cause the panels to be torn off or the panels ripped thus rendering the cartons or containers unuseable.

Usually containers with carry handle features built into the container are restricted by the design so that they will not carry very much weight without tearing apart as indicated above. Other containers with carry handle features attempting to overcome this problem involve plastic handles or some other type of handle or reinforcement. Special handles are, of course, expensive and also require extra labor in order to install them. If the panels have to be reinforced in some manner, difficulties are created with the glueing machines because of the extra requirements for the reinforcement panels. All these attempts to provide a display carry container which can be repeatedly opened and closed and which can have a handle for carrying the container and its contents which does not tear loose from the container means extra labor and costs and in some cases extra costs for both the manufacturer and the customer.

SUMMARY OF THE INVENTION

The present invention overcomes the problem of the prior art and provids a container with a carry handle feature designed to carry more weight than other containers with special carry handle features such as plastic handles or special materials for reinforcement of either the container or the handle itself. This is achieved by cutting and scoring the top closure flaps in such a way that they work with the weight of the container rather than resist the weight and tear away from the container.

Briefly stated, the invention relates to a display carry container having first and second opposed side wall panels, first and second end wall panels and bottom closure panels attached to said side wall panels for closing the bottom of said container, and having an improved top closure comprising a first flap integrally formed with and hingedly attached to said first side wall panel, said first flap having a handle integrally formed with, hingedly attached to and centered on said first flap, second and third generally U-shaped flaps integrally formed with and hingedly attached to said first and second end wall panels respectively for folding inwardly in an abutting relationship and overlapping said first flap whereby said handle protrudes through the elongated slot formed by said abutting second and third generally U-shaped flaps, a fourth flap integrally formed with and hingedly attached to said second side wall panel for folding inwardly and overlapping said first, second and third flaps, said fourth flap having an elongated slot therein for receiving said handle therethrough and fastening means for removably retaining said fourth flap in its overlapped position.

The invention further relates to a carton blank for forming a display carry container comprising first and second side wall panels and first and second end wall panels integrally formed and hingedly connected in alternated contiguous relationship, said end wall panels being of greater height than said first side wall panel and said second side wall panel being greater in height than said end wall panels, a glue flap hingedly connected to the outer edge of said first side wall panel, bottom closure panels hingedly attached to the base of said first and second side wall panels, a first flap integrally formed with and hingedly connected to the top of said first side wall panel and having a handle integrally formed therein and hingedly connected at its base thereto, second and third generally U-shaped flaps hingedly connected to and integrally formed with the top of said first and second end walls respectively, said second and third flaps overlapping said first flap when said container is folded and forming an elongated slot through which said handle can protrude and a fourth flap hingedly connected to and integrally formed with said second side wall panel and having an elongated slot therein through which said handle protrudes when said container is folded and said fourth flap overlaps said first, second and third flaps, a fifth flap integrally formed in said first side wall panel and extending into said first flap and hingedly attached at its base to said first side wall panel whereby a slot is formed in said first side wall panel and said first flap when said fifth flap is pivoted outwardly about its base, and a tab integrally formed with and hingedly attached at its base to the outer edge of said fourth flap for inserting into said slot formed by said fifth flap when said container is folded thereby retaining said fourth flap in its overlapped position.

The container blank further includes score lines extending from each corner of said first flap to the nearest end of said handle, score lines extending from each corner of said second and third flaps to the nearest end of the slot formed therein and score lines in said fourth flap extending from each end of said slot therein to the nearest edge of said fourth flap in a direction parallel to said slot therein.

The first flap of said container blank comprises a first rectangular panel hingedly attached along one edge to the top of said first side wall panel, a second rectangular panel congruent with said first rectangular panel and first and second U-shaped handle portions hingedly connected at the top thereof whereby when said handle portions are folded in overlapping relationship, they are congruent with each other, said first and second handle portions being hingedly connected at the base thereof to said first and second rectangular panels respectively.

BRIEF DESCRIPTION OF THE DRAWINGS

These and other objects and advantages of the present invention will be disclosed in the course of the following specification, reference being had to the accompanying drawings in which:

Referring to the drawings, FIG. 1 is a plan view of a carton blank incorporating the features of the display carry container in accordance with the present invention. The blank itself is generally represented by the numeral 10 and comprises first and second opposed side wall panels 12 and 14, respectively, and first and second end wall panels 16 and 18, respectively, all of said side wall panels and said end wall panels being integrally formed and hingedly attached to each other in contiguous alternate relationship at articulations 20, 22 and 24. Integrally formed with and hingedly attached at articulation 26 to the outer edge of first side wall panel 12 is glue flap 28. Integrally formed with first side wall panel 12 and hingedly attached at the bottom thereof along articulation line 30 is bottom closure panel 32. Also, integrally formed with second side wall panel 14 and hingedly attached at the bottom thereof along articulation line 34 is a second bottom closure panel 36. Bottom closure panel 36 has integrally formed therewith and hingedly attached thereto along articulation lines 38 and 40, first and second extension panels 42 and 44 respectively. When the carton is in its folded and erected state, extension panels 42 and 44 lie inside the carton along end wall panels 16 and 18 respectively.

Figure 1:
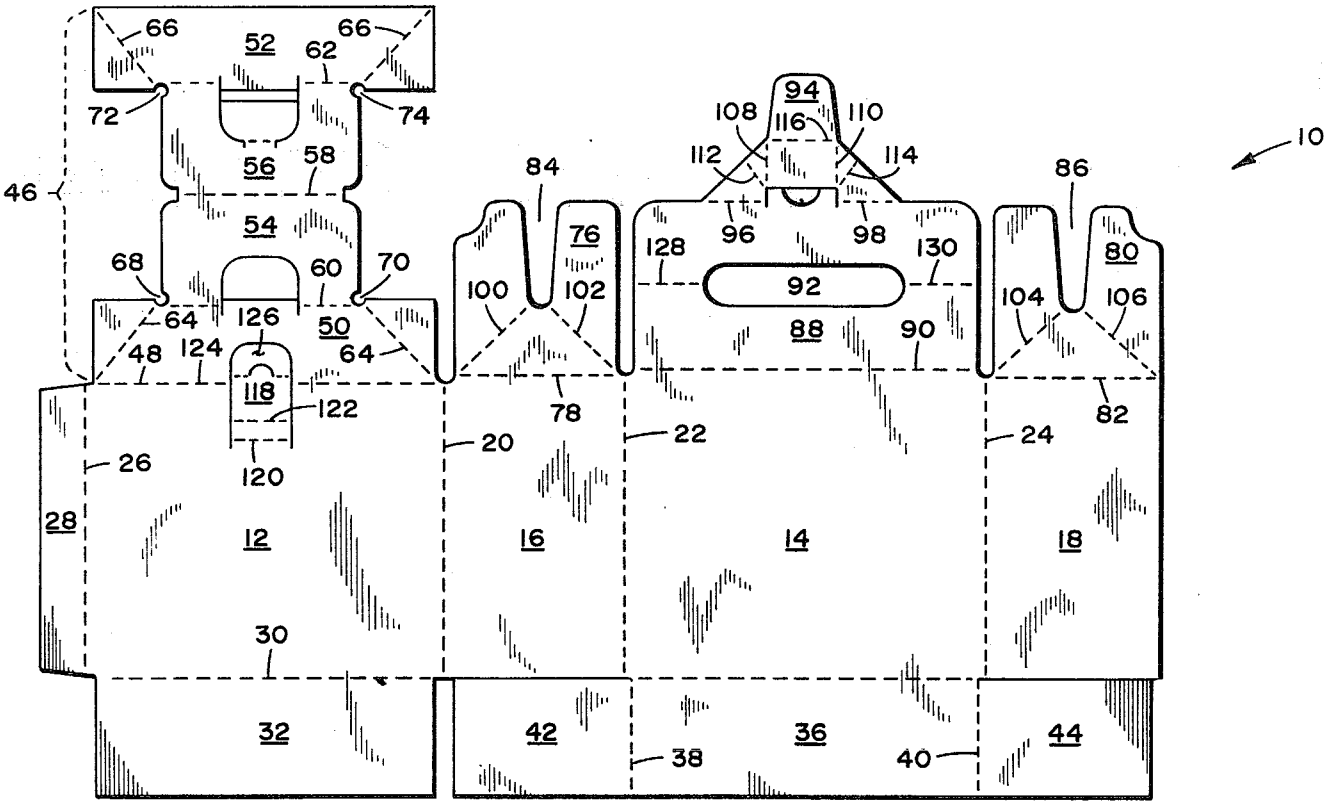
FIG. 1 is a plan view of a display carry container blank incorporating an integrally formed handle illustrating the manner in which the top flaps are scored in such a way that they work with the weight of the container to prevent tearing of the handle from the container.

A first flap, generally represented by the numeral 46, is integrally formed with and hingedly attached to the top of said first side wall panel 12 along articulation line 48. Said first flap 46 comprises a first rectangular panel 50 integrally formed with and hingedly attached to first side wall panel 12 along articulation line 48, a second rectangular panel 52 congruent with said first rectangular panel 50 and first and second U-shaped handle portions 54 and 56, respectively, hingedly connected at the top thereof along articulation line 58 whereby when said handle portions are folded in overlapping relationship, they are congruent with each other. First handle portion 54 is integrally formed with and hingedly connected at the base thereof to first rectangular panel 50 along articulation line 60. Second U-shaped handle portion 56 is integrally formed with and hingedly connected to second rectangular panel 52 along articulation line 62. Score lines 64 extend from each outer corner of said first rectangular panel 50 to the nearest outer end of first handle portion 54. Score lines 66 extend from each outer corner of said second rectangular panel 52 to the nearest end of said second handle portion 56. First flap 46 is so cut that the intersection of the outer end of handle 54 with first rectangular panel 50 are three-quarter circles 68 and 70. In like manner, the intersection of the outer ends of second rectangular panel 56 with second panel 52 are also formed by three-quarter circles 72 and 74. These three-quarter circles are so designed as to not only allow flexing of the first and second panels about score lines 64 and 66, but also to prevent tearing at the intersection of the first and second handle portions with said first and second rectangular panels by eliminating any sharp corners formed at intersections or junctions.

A second, generally U-shaped, flap 76 is integrally formed with and hingedly connected to the top of said first end wall panel 16 along line of articulation 78. A third, generally U-shaped, flap 80 is integrally formed with and hingedly connected to the top of said second end wall panel 18 along articulation line 82. Slots 84 and 86 in second and third flaps 76 and 80 respectively form an elongated slot through which the handle formed of handle portions 54 and 56 can protrude when said container is in its erected state and second and third flaps 76 and 80 respectively overlap said first flap 46.

A fourth flap 88 is hingedly connected to and integrally formed with said second side wall panel 14 along articulation line 90 and has therein an elongated slot 92 through which handle portions 54 and 56 protrude when said container is folded and said fourth flap 88 overlaps said first, second and third flaps 46, 76 and 80 respectively. A tab 94 is hingedly attached to fourth flap 88 along lines of articulation 96 and 98. The purpose of tab 94 is to hold fourth flap 88 in a secured position when the carton is completely folded. The manner in which this is accomplished will be discussed hereinafter.

Score lines 100 and 102 extend from each corner of the second flap 76 to the nearest end of slot 84 formed therein. Score lines 104 and 106 extend from each outer corner of the third flap 80 to the nearest end of slot 86 formed therein. Also associated therewith are score lines 108, 110, 112 and 114. Further a slot 116 is cut into tab 94.

A fifth flap 118 is integrally formed in said first side wall panel 12 and extends into said first flap 46 and is hingedly attached at its base to first side wall panel 12 along articulation line 120. When said fifth flap 118 is pivoted outwardly about its base along line of articulation 120, a slot is formed in said first side wall panel 12 and said first flap 46 for receiving tab 94 when said container is folded thereby retaining said fourth flap in its overlapped position. A second line of articulation 122 is formed just above base articulation line 120. A third line of articulation 124 is formed just below the top of fifth flap 118 to allow the formation of a second tab 126 which can be inserted in slot 116 of first tab 94 when said carton is in its folded condition to lock tab 94 in place.

Figure 2:
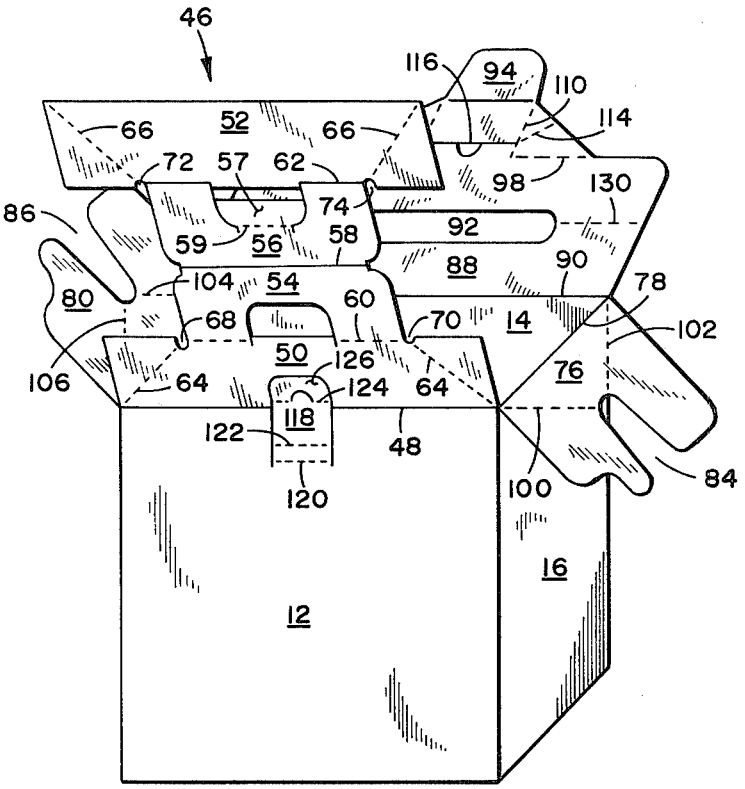
FIG. 2 is a perspective view of the display carry container with all top flaps opened and ready for folding.

FIG. 2 is a perspective view of the display carry container with all top flaps opened and ready for folding.

Figure 3:
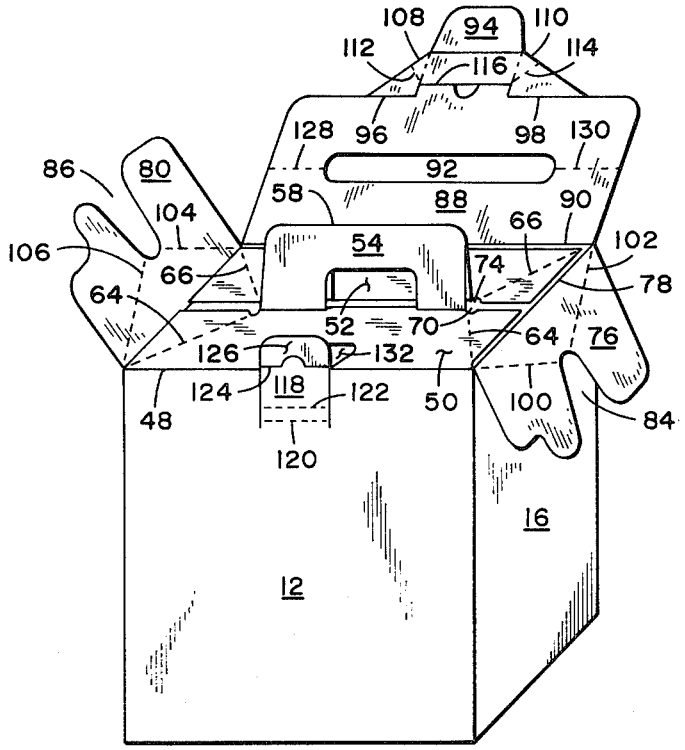
FIG. 3 is a perspective view of the display carry container with the first flap in its folded position in said container.

FIG. 3 is a perspective view of the display carry container with first flap 46 in its folded position in said container. As can be seen in FIG. 3, when first flap 46 is folded within the container, first and second rectangular panels 50 and 52 respectively are in abutting relationship to each other and generally close the top of the container. This also places first and second handle portions 54 and 56 in abutting superimposed relationship, folded together about line of articulation 58 and perpendicular to panels 50 and 52. A slot 132 is formed when fifth flap 118 and its associated second tab 126 is pulled from first panel 50 in the course of the folding of the carton. In the position shown in FIG. 3, generally U-shaped second and third flaps 76 and 80 are in a position to be folded over first flap 46 such that superimposed handles 54 and 56 extend upwardly and through the elongated slot formed when slots 84 and 86 are in abutting relationship.

Figure 4:
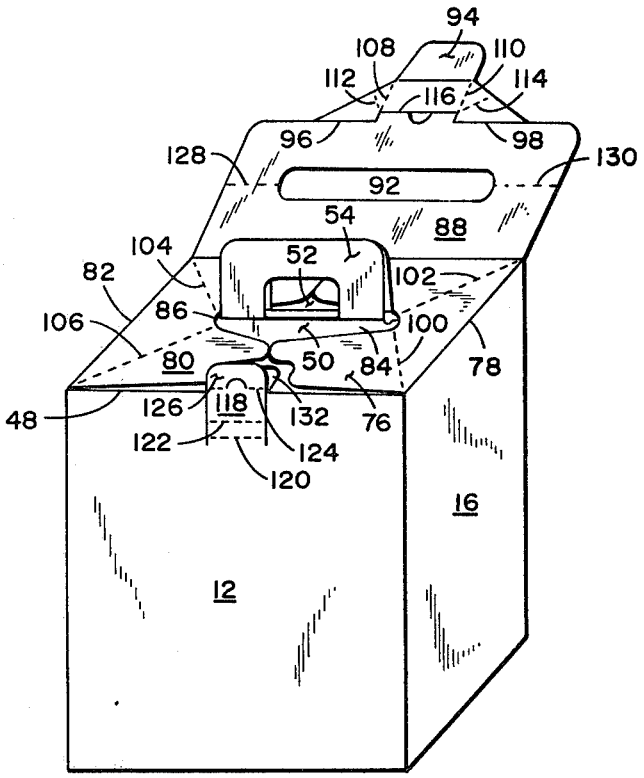
FIG. 4 is a perspective view of the display carry container with the U-shaped second and third flaps in their folded position overlapping said first flap.

This can be seen more clearly in FIG. 4 which is a perspective view of the display carry container with the U-shaped second and third flaps in their folded position overlapping said first flap. First and second handle portions 54 and 56 are in superimposed abutting relationship with each other and protrude through the elongated slot formed by slots 84 and 86 in the respective second and third U-shaped flaps 76 and 80.

Figure 5:
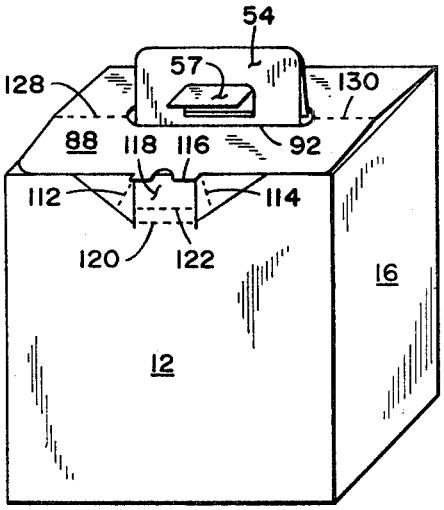
FIG. 5 is a perspective view of the display carry container wherein the fourth flap is in its folded position overlapping said second and third flaps with the handle of the first flap protruding through the slot therein.

FIG. 5 is a perspective view of the display carry container wherein the fourth flap 88 is in its folded position overlapping second and third flaps 76 and 80 with the handle formed by first and second handle portions 54 and 56 of the first flap 46 protruding through the slot 92 formed in said fourth flap 88. It will be noted that tab 94 is inserted under fifth flap 118 with the upper portion 126 of fifth flap 118 folded about score line 124 and inserted in slot 116 in tab 94 to lock the fourth flap 88 in place.

Figure 6:
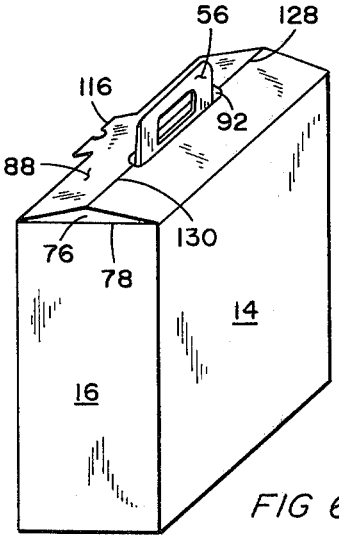
FIG. 6 is another perspective view of the display carry container with the top closure panels in their completely folded condition showing the container in a state ready for carrying.

FIG. 6 is a perspective view of the display carry container with each of the top closure panels in its completely folded condition showing the container in a state ready for carrying materials for display purposes.

From FIGS. 3, 4 and 5 it can be seen how the articulations or score lines tend to distribute any force applied to handles 54 and 56 to both side wall panels 12 and 14 and both end wall panels 16 and 18 whereby a tendency of the handle and flaps to tear is minimized. Notice score lines 64 and 66 shown in FIG. 3 which extend from each outer corner of first flap 46 to the nearest end of said handle 54 or 56. Notice also in FIG. 4 that score lines or articulations 100, 102, 104 and 106 in second and third generally U-shaped flaps 76 and 80 are superimposed upon associated score lines or articulations 64 and 66 in first flap 46. It can be readily seen that when force is applied to generally U-shaped handles 54 and 56, the pull of the container or its weight will cause flexing or bending about score lines 64 and 66 and the corresponding superimposed score line 100, 102, 104 or 106.

It will be understood that the flexing or bending of first flap 46 along score lines 64 and 66 and the corresponding superimposed score lines 100, 102, 104 and 106 in generally U-shaped second and third flaps 76 and 80 not only distributes the force applied to the handle to end wall panels 16 and 18 and side wall panels 12 and 14 to more equally distribute the forces applied to the handle but also avoid rigidity. Note also that when the fourth flap 88 is folded over generally U-shaped second and third flaps 76 and 80 and locked in that position, any upward forces applied to handle 54 and 56 cause flexing or bending about score lines 128 and 130 in fourth flap 88 thus distributing that weight to the side wall panels 12 and 14.

Thus not only the flexing of the top closure flaps, and thus the avoidance of rigidity, but also the distribution of the force over the entire top closure panels prevents tearing of the handle or the flaps and lengthens the useful life of the display carry container.

Figure 7:
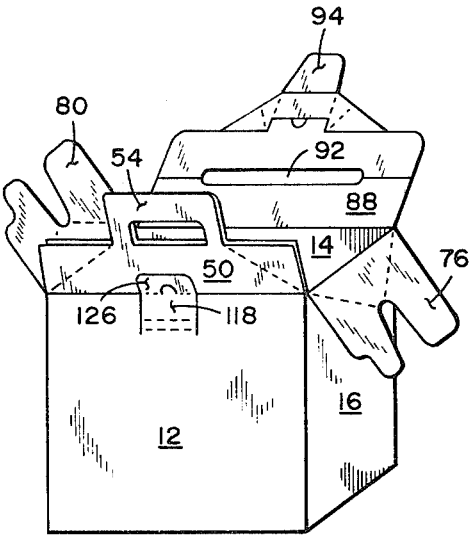
FIG. 7, FIG. 8, FIG. 9 and FIG. 10 illustrate the closure of the display carry container for shipment in a master pack wherein the handle is folded within and does not protrude from the carton.

FIGS. 7, 8, 9 and 10 illustrate the closure of the display carry container for shipment in a master pack wherein the handle is folded within and does not protrude from the carton. FIG. 7 shows that the first and second rectangular panels 50 and 52 of first flap 46 and their associated generally U-shaped handle portions 54 and 56 respectively are folded in a congruent relationship with each other such that handle portion 56 overlaps and is congruent with handle portion 54 and second panel 52 overlaps and is congruent with first panel 50.

Figure 8:
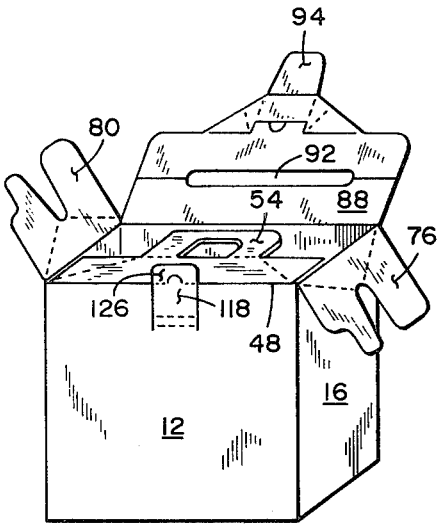
Figure 9:
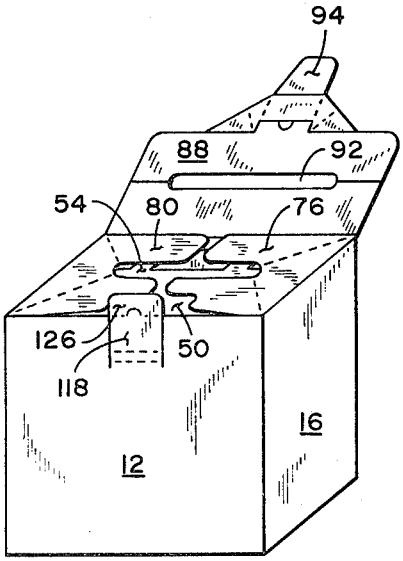

FIG. 8 illustrates the manner in which the folded first flap 46 in its congruent relationship is pivoted about articulation line 48 until it lies just within the container itself. FIG. 9 illustrates how the second and third U-shaped flaps 76 and 80 overlap the folded and congruent first flap 46. Notice that the handle portions 54 and 56 do not protrude through the generally elongated slot formed by second and third flaps 76 and 80.

Figure 10:
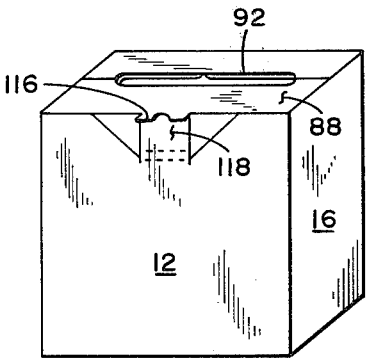

FIG. 10 shows the completely folded carton without the handle protruding therefrom. Tab 94 has been inserted behind fifth flap 118 and the top portion 126 of fifth flap 118 is inserted in slot 116 of tab 94.

In the assembled condition shown in FIG. 10, the containers can be conveniently packaged without loss of space because the handle is folded inwardly and does not protrude from the container. Thus the container can be conveniently shipped in quantities.

As to materials, the container can be made of any of the usual paper stock, such as paperboard conventionally used for this purpose. In like manner, conventional container forming apparatus can be used to form the blanks and to assemble the containers from such blanks.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. In a display carry container having first and second opposed side wall panels, first and second end wall panels and bottom closure panels attached to said side wall panels for closing the bottom of said container, an improved top closure comprising:

(a) a first flap integrally formed with and hingedly attached to said first side wall panel, (i) said first flap having a handle integrally formed with, hingedly attached to and centered on said first flap, (b) second and third generally U-shaped flaps integrally formed with and hingedly attached to said first and second end wall panels respectively for folding inwardly in an abutting relationship and overlapping said first flap whereby said handle protrudes through the elongated slot formed by said abutting second and third generally U-shaped flaps, (c) a fourth flap integrally formed with and hingedly attached to said second side wall panel for folding inwardly and overlapping said first, second and third flaps, (i) said fourth flap having an elongated slot therein for receiving said handle therethrough, and (d) fastening means for removably retaining said fourth flap in its overlapped position.

2. A container as in claim 1 further including:

(a) a line of articulation extending from each corner of said first flap to the nearest end of said handle, (b) a line of articulation extending from each corner of said second and third flaps to the base of the respective slot formed therein when folded, (i) each of said articulations in said second and third flaps being generally superimposed upon and congruent with a corresponding articulation in said first flap, and (c) a line of articulation in said fourth flap extending from each end of said slot therein to the nearest edge of said fourth flap in a direction parallel to said slot therein, (i) said articulations tending to distribute any force applied to said handle to both side and both end walls of said container whereby a tendency of the handles and flaps to tear is minimized.

3. A container as in claim 2 further including:

(a) a rounded corner at each end of said handle where said handle attaches to said first flap whereby a tendency of said corner to tear is minimized.

4. A container as in claim 3 wherein said fastening means comprises:

(a) a fifth flap integrally formed with said first side wall panel and extending beyond the articulation line of said first side wall panel into said first flap, said fifth flap being hingedly attached at its base to said first side wall panel to form a slot therein, and (b) an elongated tab integrally formed with, hingedly attached to and extending outwardly from the outer edge of said fourth flap whereby in an overlapped condition of said first and fourth flaps, said tab may be inserted in the slot formed by pivoting said fifth flap outwardly about its base.

5. A container as in claim 4 wherein said fastening means further includes:

(a) a horizontal slot in said tab along its hinge line with said fourth flap whereby the outer end of said fifth flap may be inserted in said horizontal slot in said tab to removably retain said fourth flap in an overlapping relationship with said first, second and third flaps.

6. A container as in claim 5 wherein:

(a) the hinge line of said second and third flaps is higher from the bottom of said container than the hinge line of said first flap whereby a smooth overlap of said second and third flaps over said first flap occurs.

7. A container as in claim 6 wherein:

(a) the hinge line of said fourth flap is higher from the bottom of said container than the hinge line of said second and third flaps whereby a smooth overlap of said fourth flap over said second and third flaps occurs.

8. In a display carry container having first and second opposed side wall panels, first and second end wall panels and bottom closure panels for closing the bottom of said container, an improved top closure comprising:

(a) a first flap integrally formed with said first side wall panel and having a handle integrally formed therein, (b) second and third flaps integrally formed with said first and second end wall panels respectively for overlapping said first flap and forming an elongated slot through which said handle protrudes, (c) a fourth flap integrally formed with said second side wall panel and having an elongated slot therein through which said handle protrudes when said fourth flap overlaps said second and third flaps, and (d) means removably retaining said fourth flap in its overlapped position.

9. A container as in claim 8 further including:

(a) score lines in said first, second, third and fourth flaps whereby an upward force applied to said handle is generally distributed to said side wall panels and said end wall panels whereby tearing is minimized.

10. A display carry container as in claim 8 wherein said first flap comprises:

(a) a first rectangular panel hingedly attached on one edge to the top of said first side wall panel, (b) a second rectangular panel congruent with said first rectangular panel and (c) first and second U-shaped handle portions hingedly connected at the top thereof whereby when said handle portions are folded in overlapping relationship, they are congruent with each other, (i) said first and second handle portions being hingedly connected at the bases thereof to said first and second rectangular panels respectively whereby said first and second rectangular panels may be adjacent each other in a horizontal plane with the handle portions 54 and 56 protruding perpendicularly therefrom or may be in an overlapped and congruent relationship with each other whereby both rectangular panels and the handle portions may be folded inwardly within said container without the handle protruding therefrom.

11. A container blank for forming a display carry container comprising:

(a) first and second side wall panels and first and second end wall panels integrally formed and hingedly connected in alternated contiguous relationship, said end wall panels being of greater height than said first side wall panel and said second side wall panel being greater in height than said end wall panels, (b) a glue flap hingedly connected to the outer edge of said first side wall panel, (c) bottom closure panels hingedly attached to the base of said first and second side wall panels, (d) a first flap integrally formed with and hingedly connected to the top of said first side wall panel and having a handle integrally formed therein and hingedly connected at its base thereto, (e) second and third generally U-shaped flaps hingedly connected to and integrally formed with the top of said first and second end walls respectively, said second and third flaps overlapping said first flap when said container is folded and forming an elongated slot through which said handle can protrude and (f) a fourth flap hingedly connected to and integrally formed with said second side wall panel and having an elongated slot therein through which said handle protrudes when said container is folded and said fourth flap overlaps said first, second and third flaps.

12. A container blank as in claim 11 further including:

(a) a fifth flap integrally formed in said first side wall panel and extending into said first flap and hingedly attached at its base to said first side wall panel whereby a slot is formed in said first side wall panel and said first flap when said fifth flap is pivoted outwardly about its base, and (b) a tab integrally formed with and hingedly attached at its base to the outer edge of said fourth flap for inserting into said slot formed by said fifth flap when said container is folded thereby retaining said fourth flap in its overlapped position.

13. A container blank as in claim 12 further including:

(a) score lines extending from each outer corner of said first flap to the nearest end of said handle, (b) score lines extending from each corner of said second and third flaps to the nearest end of the slot formed therein, and (c) score lines in said fourth flap extending from each end of said slot therein to the nearest edge of said fourth flap in a direction parallel to said slot therein.

14. A container blank as in claim 13 wherein said first flap comprises:

(a) a first rectangular panel hingedly attached along one edge to the top of said first side wall panel, (b) a second rectangular panel congruent with said first rectangular panel, and (c) first and second U-shaped handle portions hingedly connected at the top thereof whereby when said handle portions are folded in an overlapping relationship, they are congruent with each other, (i) said first and second handle portions being hingedly connected at the bases thereof to said first and second rectangular panels respectively.

* * * * *